US011358261B2

(12) United States Patent
Bonas

(10) Patent No.: US 11,358,261 B2
(45) Date of Patent: Jun. 14, 2022

(54) APPARATUS FOR TIGHTENING THREADED FASTENERS

(71) Applicant: HYTORC Division UNEX Corporation, Mahwah, NJ (US)

(72) Inventor: Calvin A. Bonas, Bronx, NY (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 490 days.

(21) Appl. No.: 16/538,347

(22) Filed: Aug. 12, 2019

(65) Prior Publication Data

US 2020/0171629 A1 Jun. 4, 2020

Related U.S. Application Data

(63) Continuation-in-part of application No. 14/000,231, filed as application No. PCT/US2012/025747 on Feb. 17, 2012, now abandoned.

(60) Provisional application No. 61/443,736, filed on Feb. 17, 2011.

(51) Int. Cl.
*B25B 23/00* (2006.01)

(52) U.S. Cl.
CPC ..... *B25B 23/0078* (2013.01); *B25B 23/0085* (2013.01)

(58) Field of Classification Search
CPC ..... B25B 23/0078; B25H 1/0064; B23Q 9/0014; F16M 11/046
USPC ..... 81/53.3, 57.14, 57.22, 57.35, 57.24
See application file for complete search history.

(56) References Cited

U.S. PATENT DOCUMENTS 4,011,024 A * 3/1977 Nakano ..... B23B 47/28 408/712
4,962,566 A * 10/1990 Gemma ..... B08B 1/04 15/88.4
10,926,365 B2 * 2/2021 Wen ..... B23P 19/069

* cited by examiner

*Primary Examiner* — Bryan R Muller
(74) *Attorney, Agent, or Firm* — Justin B. Bender, Esq.

(57) ABSTRACT

Apparatus for use with a tool assembly in operations of tightening or loosening threaded fasteners about an axis are disclosed, and in one example includes: a lower clamp assembly; an upper clamp assembly; a reaction adaptor assembly; and a spring assembly formed between the upper clamp assembly and the reaction adaptor assembly. Advantageously an operator can tighten or loosen all fasteners without having to change the initial setup of the apparatus. The lower clamp assembly eliminates the need for extra operators and heavy and bulky equipment to hold the apparatus near the fasteners. The upper clamp allows the operator to rotate the apparatus around with ease. The spring assembly stabilizes and eases vertical height adjustment of the apparatus. The reaction adaptor substantially negates reaction turning forces of the tool assembly during the operations. Drive knobs provide easy alignment of and quick and safe mounting of the tool assembly on the fasteners. Bolting operations about an axis are completed faster, cheaper and with little or no risk of operator injury.

14 Claims, 3 Drawing Sheets

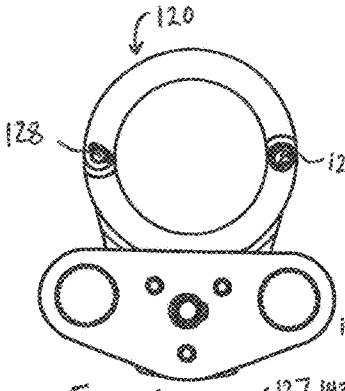
FIG. 6A
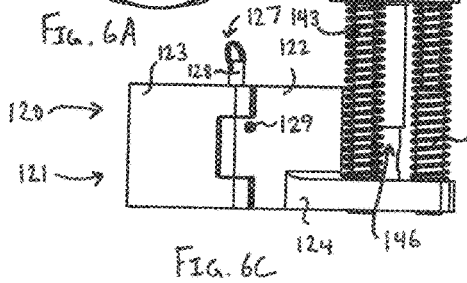
FIG. 6C
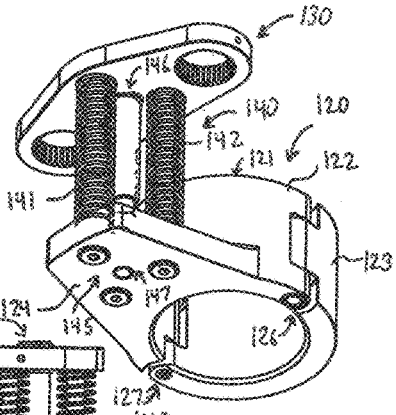
FIG. 6B
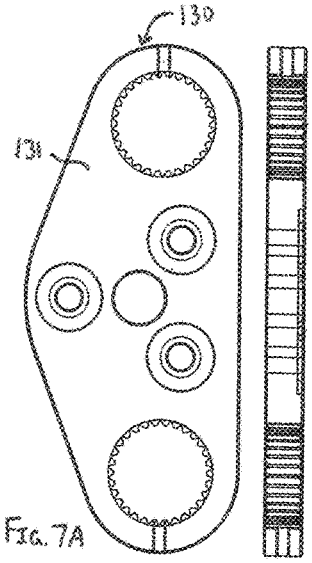
FIG. 7A
FIG. 7B
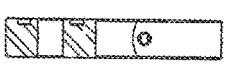
FIG. 7C
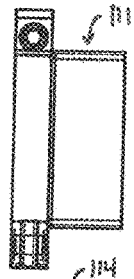
FIG. 8A
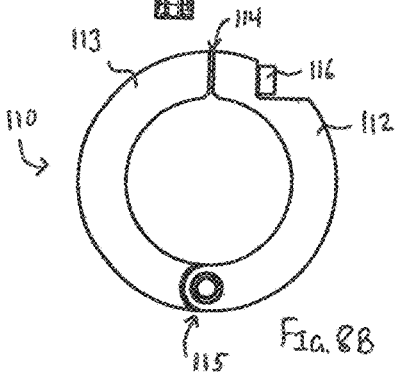
FIG. 8B
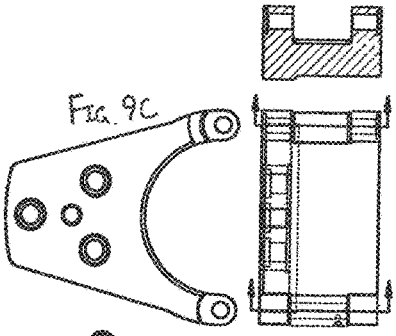
FIG. 9B
FIG. 9C
FIG. 9D
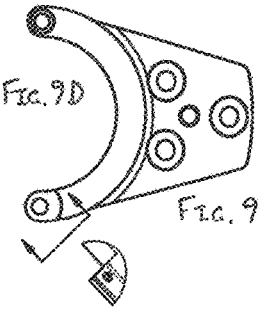
FIG. 9E
FIG. 9F
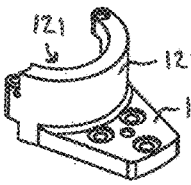
FIG. 9A
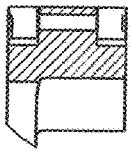
FIG. 9G

APPARATUS FOR TIGHTENING THREADED FASTENERS

CROSS REFERENCE TO RELATED APPLICATIONS

This application is either a U.S. National Application Filed Under 35 U.S.C. 371, continuation and/or continuation-in-part application of the following commonly owned U.S. and PCT applications, entire copies of which are incorporated herein by reference: Ser. No. 12/428,200, having filing date of Apr. 22, 2009, that is entitled "Reaction Adaptors for Torque Power Tools and Methods of Using the Same"; Ser. No. 12/574,784, having Filing date of Oct. 7, 2009, that is entitled "Reaction Adaptors for Torque Power Tools and Methods of Using the Same"; 61/261,378, having filing date of Nov. 16, 2009, that is entitled "Reaction Adaptors for Torque Power Tools"; 61/267,694, having filing date of Dec. 8, 2009, that is entitled "Apparatus for Tightening or Loosening Fasteners"; PCT/US10/032139, having filing date of Apr. 23, 2010, that is entitled "Apparatus for Tightening or Loosening Fasteners"; PCT/US10/56907, having filing date of Nov. 16, 2010, that is entitled "Apparatus for Tightening or Loosening Fasteners"; and 61/443,736, having filing date of Feb. 17, 2011, that is entitled "Apparatus for Tightening Threaded Fasteners"; and PCT/US12/25747, having Filing Date of 17 Feb. 2012, entitled "APPARATUS FOR TIGHTENING THREADED FASTENERS"; and Ser. No. 14/000,231, having Filing Date of 19 Aug. 2013, entitled "APPARATUS FOR TIGHTENING THREADED FASTENERS".

DESCRIPTION OF INVENTION

Novel reaction fixtures and adaptors are known through recent patent application disclosures and applied to inverted applications such as for example underground mining, excavation and tunneling operations. Need exists for novel reaction fixture solutions for inverted socket head cap screw (SHCS) bolting applications, particularly joint closure at main stop valve (MSV) pressure seal heads.

Current methods require heavy and bulky equipment to hold the flange and torque power tools up to the joint-to-be-closed to tighten or loosen the threaded fasteners. Other methods include suspending the necessary equipment from adjacent structures, using articulated arms or other support fixtures. Often several operators are needed to carry out one tightening or loosening operation, which may take several hours of challenging work. Operator injuries also are prevalent.

What are needed are reaction mechanisms which overcome the deficiencies of the prior art.

The present invention has therefore been devised to address these issues.

Apparatus for use with a tool assembly in operations of tightening or loosening threaded fasteners about an axis are disclosed, and in one example includes: a lower clamp assembly; an upper clamp assembly; a reaction adaptor assembly; and a spring assembly formed between the upper clamp assembly and the reaction adaptor assembly. Advantageously an operator can tighten or loosen all fasteners without having to change the initial setup of the apparatus. The lower clamp assembly eliminates the need for extra operators and heavy and bulky equipment to hold the apparatus near the fasteners. The upper clamp allows the operator to rotate the apparatus around with ease. The spring assembly stabilizes and eases vertical height adjustment of the apparatus. The reaction adaptor substantially negates reaction turning forces of the tool assembly during the operations. Drive knobs provide easy alignment of and quick and safe mounting of the tool assembly on the fasteners. Bolting operations about an axis are completed faster, cheaper and with lithe or no risk of operator injury.

For a fuller understanding of the nature and advantages of the present invention, as well as the preferred mode of use, reference should be made to the following detailed description read in conjunction with the accompanying drawings:

FIGS. 6A-6C are top, bottom-up perspective and side views of component(s) of FIG. 1;

FIGS. 7A-7C are top, front cross-sectional and side views of component(s) of FIG. 1;

FIGS. 8A-8B are side and top views of component(s) of FIG. 1; and

FIGS. 9A-9G are various views of component(s) of FIG. 1.

Figure 1:
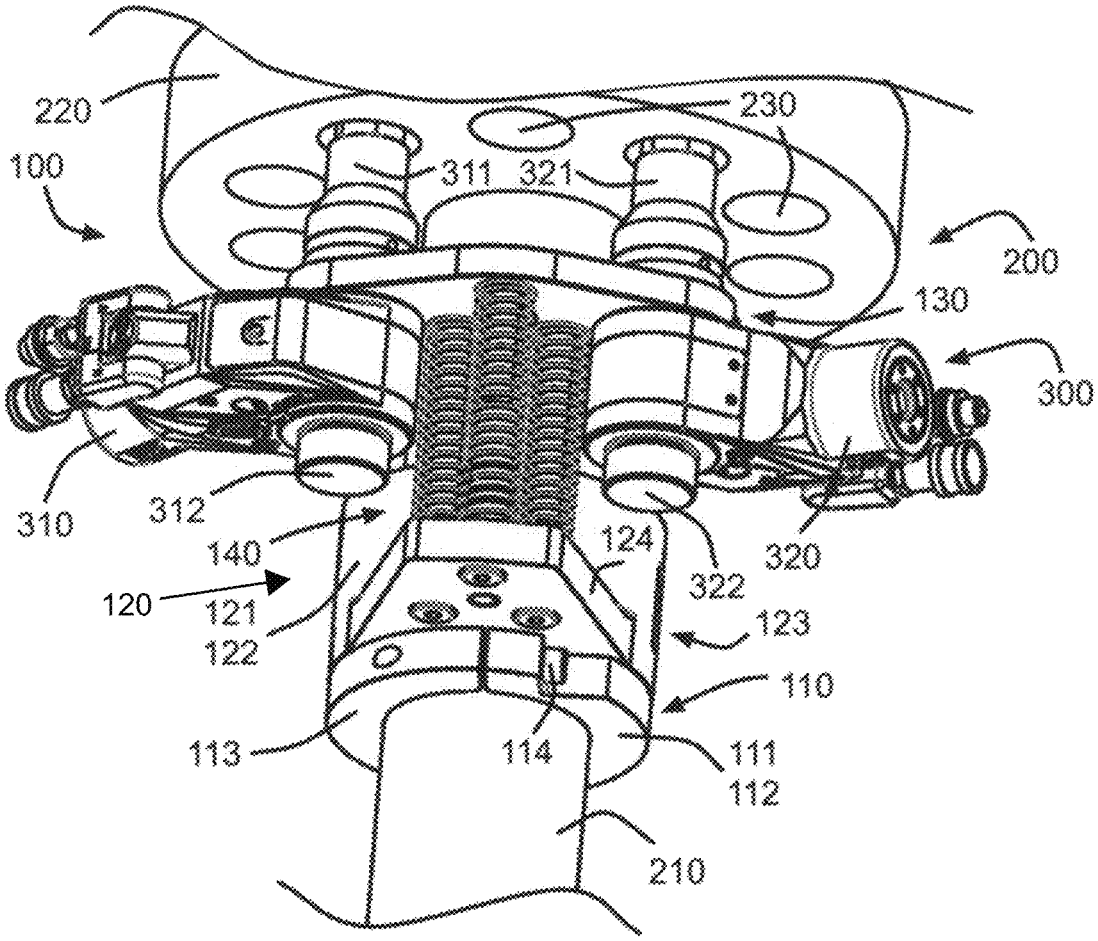
FIG. 1 is a bottom-up perspective view of an embodiment of the present invention.

Referring to FIG. 1, by way of example, shows a first aspect of the invention. We provide an apparatus 100 for reaction-free and hands-free tightening and loosening of threaded fasteners 230 at a location 200, an inverted SHCS joint closure 201 at a MSV pressure seal head 202. Location 200 includes a pipe stem 210, a flange 220, and fasteners, or SHCSs 230.

Referring to all FIGs., by way of example, apparatus 100 includes a lower clamp assembly 110, an upper clamp assembly 120, a reaction adaptor assembly 130 and a spring assembly 140 formed between upper clamp assembly 120 and reaction adaptor assembly 130. Lower clamp assembly 110, such as for example a fixed clamp, includes an annular hollow body 111 which has a first portion 112 and a second portion 113. First and second portions 112 and 113 are connected on one side by a first closing mechanism 115, such as, for example, a hinge assembly, and connected on the other side by a second closing mechanism 114, such as, for example, a connector, which may include a setscrew 116. Lower clamp assembly 110 is nonrotatably connected to and may have an interference fit against pipe stem 210, which prevents vertical and rotational movement upon installation. It supports the weight of the rest of apparatus 100 and tool assembly 300 which includes tools 310 and 320 and other ancillary components including hex sockets 311 and 321 and drive knobs 312 and 322. Lower clamp assembly 110 is used to set apparatus 100 and tool assembly 300 at a predetermined height $H_{100}$ needed to engage male hex sockets 311 and 321 in the cap screws of fasteners 230. Note that lower clamp assembly 110 has a height $H_{110}$. Lower clamp assembly 110 makes the apparatus hands free after setup.

Figure 3:
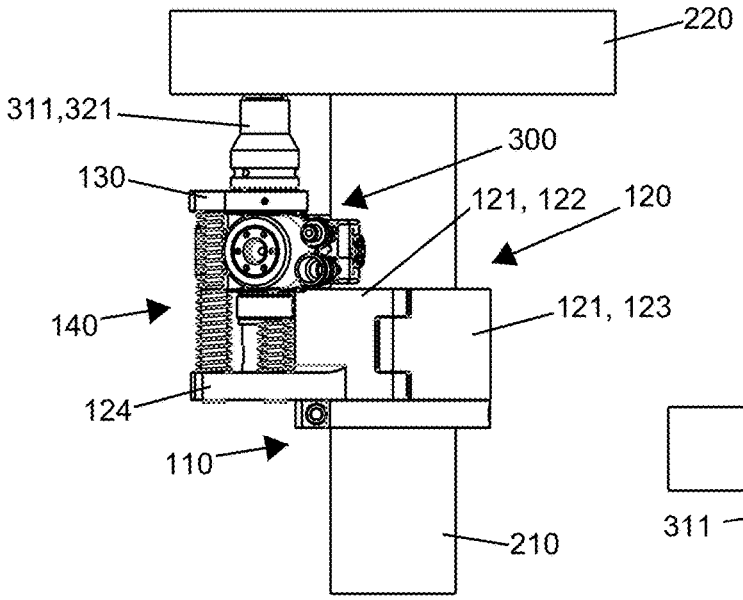
FIG. 3 is a second side view of FIG. 1.
Figure 4:
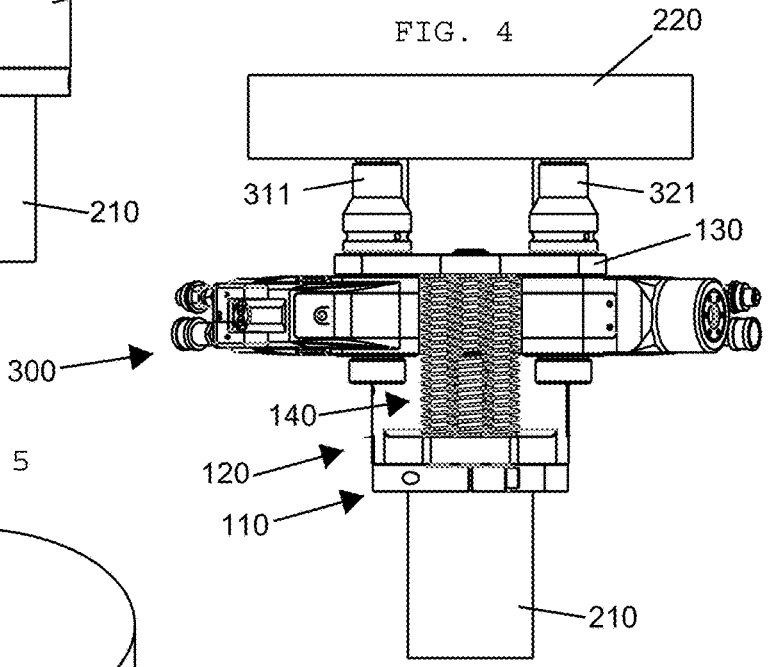
FIG. 4 is a larger view of FIG. 2.
Figure 5:
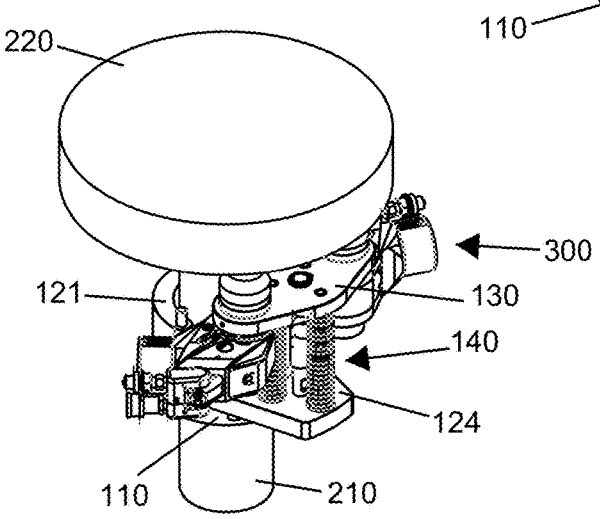
FIG. 5 is a top-down perspective view of FIG. 1.

Upper clamp assembly 120, such as for example an adjustable clamp, includes an annular hollow body 121 which has a first portion 122 and a second portion 123. First portion 122 includes a platform assembly 124. First and second portions 122 and 123 are connected in a similar manner as one side of first and second portions 112 and 113 of lower clamp assembly 110. As shown in FIGS. 3, 6 and 8, a first closing mechanism 126, such as, for example, a hinge assembly connects first and second portions 122 and 123 and platform assembly 124 on one side. Upper clamp assembly 120 is rotatably connected to pipe stem 210 by tightening a second closing mechanism 127, as shown in FIG. 6, which may include connectors, such as, for example, a link pin 128, a ball plunger 129 and/or retaining rings. Platform assembly 124 is connected to first portion 123 and, therefore, upper clamp assembly 120, by first and second closing mechanisms 126 and 127.

This closure results in a loose tolerance which allows upper clamp assembly 120 to rotate around the axis of pipe stem 210. Upper clamp assembly rests also on yet is also rotatable around lower clamp assembly 110. Upper clamp assembly 120 is used to set apparatus 100 and tool assembly 300 at a pre-determined height $H_{120}$ needed to engage male hex sockets 311 and 321 in the cap screws of fasteners 230. Note that annular hollow body 121 has a height $H_{121}$. Note that platform 124 may be formed as any suitable shape and with any suitable dimension, and in this case is formed as a trapezoid.

Reaction adaptor assemblies are thoroughly disclosed and discussed in commonly owned international patent application PCT/US10/032139, having filing date of Apr. 23, 2010, that is entitled "Apparatus for Tightening or Loosening Fasteners" (the '139 Application), an entire copy of which is incorporated herein by reference. Reaction adaptor assembly 130 includes a platform assembly 131. Such reaction adaptor assemblies are used in commerce under Applicant's trade name TWIN TORQUE®. Reaction adaptor assembly 130, a type similar to those described in the '139 Application, connects tools 310 and 320 such that the reaction forces created during operation are absorbed and cancel one another. The torque being applied to fasteners 230, and therefore the reaction forces, are substantially equal and opposite. Note that that various changes, combinations, alterations, and variations of aspects of the '139 Application may be used in conjunction with the present invention.

Formed between and connecting platform assembly 124 of upper clamp assembly 120 and reaction adaptor assembly 130 is a spring assembly 140. Spring assembly 140 includes three spring coil with telescoping core assemblies 141, 142 and 143 and a support telescoping shaft assembly 146, which allow reaction adaptor assembly 130 (and, therefore, tools 310 and 320 and other ancillary components including hex sockets 311 and 321 and drive knobs 312 and 322) to move up and down.

An attachment mechanism 145 of spring coil with telescoping core assemblies 141, 142 and 143 and an attachment mechanism 147 of support shaft telescoping assembly 146 connect both platform assemblies 124 and 131. Attachment mechanisms 145 and 147 may include circular indentions in platform assemblies 124 and 131 and connectors, such as, for example, shoulder screws and/or retaining rings.

Spring assembly 140 keeps constant vertical pressure on reaction adaptor assembly 130 and therefore tool assembly 300 to maintain engagement of male hex sockets 311 and 321 and SHCSs 230 at location 200. Furthermore spring assembly 140 allows male hex sockets 311 and 321 to be removed from SHCSs 230 upon loosening. An operator is able to remove male hex sockets 311 and 321 from one set of SHCSs 230 and rotate and replace the sockets onto another set of SHCSs 230. The operator can thus tighten all the SHCSs 230 at location 200 without having to change the initial setup.

Figure 2:
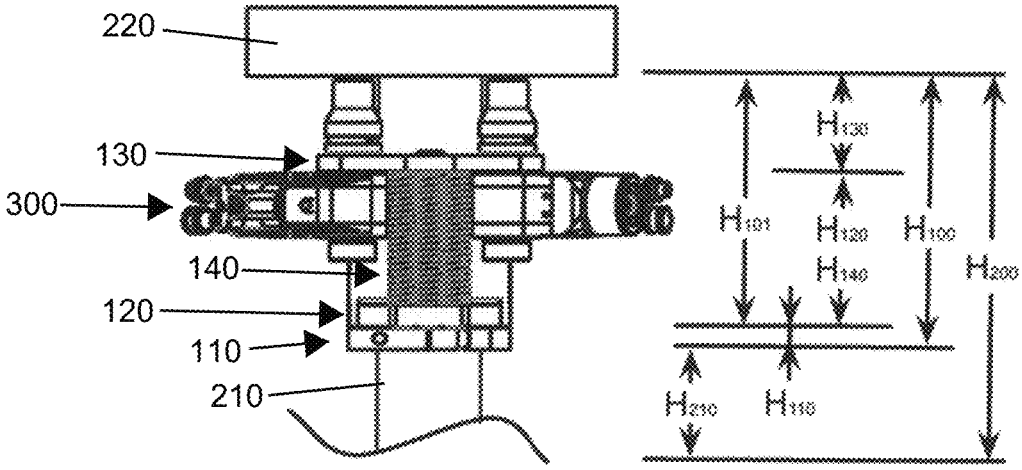
FIG. 2 is a side view of FIG. 1.

FIG. 2 shows various heights associated with apparatus 100. $H_{100}$ indicates the distance between a lower face of lower clamp assembly 110 and a lower face of flange 220. $H_{110}$ indicates the height of lower clamp assembly 110. $H_{120}$ indicates the height of upper clamp assembly 120. $H_{130}$ indicates the distance between a lower face of reaction assembly 130 and a lower face of flange 220. $H_{140}$ indicates the variable height of spring assembly 140. Note that $H_{200}$ and $H_{210}$ are arbitrary distances dependent on characteristics further along pipe stem 210.

During installation of apparatus 100 and tool assembly 300 about location 200, the operator installs lower clamp assembly 110 at pre-determined height $H_{100}$ from flange 220. The operator then installs upper clamp assembly 120 around pipe stem 210 by connecting first portion 122, second portion 123 and platform assembly 124 via first closing mechanism 126. These components of upper clamp assembly 120 are wrapped around hollow body 111 and statically connected to each other and rotatably connected to lower clamp assembly 110 and pipe stem 210 via second closing mechanism 127. Spring assembly 140 is installed between platform assembly 124 of upper clamp assembly 120 and reaction adaptor assembly 130, by placing the ends of spring coil with telescoping core assemblies 141, 142 and 143 and support telescoping shaft assembly 146 in the circular indentions of attachment mechanisms 145 and 147. The operator then tightens the connectors of attachment mechanisms 145 and 147. Tools 310 and 320 are attached to reaction adaptor assembly 130 and male hex sockets 311 and 321 are installed on the drive shafts of the tools. The operator performs the reverse of this installation process to uninstall apparatus 100 and tool assembly 300 from location 200. Indeed the lower clamp assembly 110, upper clamp assembly 120, reaction adaptor assembly 130, spring assembly 140 and tool assembly 300 are attachable separately, individually and independently to each other.

During operation of apparatus 100 the operator orients male hex sockets 311 and 321 with the female hex engagements of two of SHCSs 230 using drive knobs 312 and 322. Drive knobs 312 and 311 allow the operator to turn and position reaction adaptor assembly 130 without removing tools 310 and 320. These hexes, once aligned and positioned, will keep their engagement with the selected two SHCSs 230. The operator then tightens or loosens the selected two SHCSs 230 as desired. The operator disengages male hex sockets 311 and 321 from the selected two SHCSs 230 by applying pressure to spring assembly 140 then rotates upper clamp assembly 120 and therefore all other attached components to fit two other SHCSs 230 on flange 220. The operator repeats this operation process until all SHCS 230 are tightened or loosened.

Apparatus 100 includes: lower clamp assembly 110; upper clamp assembly 120; reaction adaptor assembly 130; and spring assembly 140 formed between upper clamp assembly 120 and reaction adaptor assembly 130. Advantageously the operator can tighten or loosen all of SHCSs 230 at location 200 without having to change the initial setup of apparatus 100. Lower clamp assembly 110 eliminates the need for extra operators and heavy and bulky equipment to hold apparatus near location 200. Upper clamp 120 allows the operator to rotate apparatus 100 around pipe stem 210 with ease. Spring assembly 140 stabilizes and eases vertical height adjustment of apparatus 100. Reaction adaptor 130 substantially negates reaction turning forces of tool assembly 300 during the operations. Drive knobs 312 and 322 provide easy alignment of and quick and safe mounting of tool assembly 300 on SHCSs 230. Bolting operations about an axis are completed faster, cheaper and with little or no risk of operator injury.

Apparatus 100 is described in this specification for use with inverted SHCS bolting applications, particularly joint closure at MSV pressure seal heads. Apparatus 100, and modifications thereof, may be used with many other bolting applications.

When used in this specification and claims, the terms "comprises", "includes" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

It is to be understood that the above is merely a description of preferred embodiments of the present application and that various changes, combinations, alterations, and variations may be made without departing from the true spirit and scope of the invention as set for in the appended claims. The reaction adaptors for torque power tools, tools having the adaptors, and methods of using the same of the present application are described in relation to fasteners and connectors as examples. However, the reaction adaptors for torque power tools, tools having the adaptors, and methods of using the same are viable for use in other residential, commercial, and industrial applications, as well as other devices all together. Few if any of the terms or phrases in the specification and claims have been given any special meaning different from their plain language meaning, and therefore the specification is not to be used to define terms in an unduly narrow sense.

What is claimed is:

1. An apparatus for use with a tool assembly in inverted operations of tightening or loosening a plurality of industrial threaded fasteners about an axis including:

a lower clamp assembly non-rotatably connectable about the axis and including an annular hollow body formed by a first portion and a second portion;

an upper clamp assembly rotatably connectable about and extending around part of the lower clamp assembly, including an annular hollow body formed by a first portion and a second portion and having a platform assembly;

a reaction adaptor assembly configured to support at least first and second fastener driving mechanisms of a tool assembly;

a spring assembly formed between the platform assembly and the reaction adaptor assembly; and the reaction adaptor assembly is non-rotatably connectable to and vertically positionable from the platform assembly by the spring assembly.

2. An apparatus according to claim 1 wherein the first portion and a second portion of the lower clamp assembly are connected by a first closing mechanism and a second closing mechanism.

3. An apparatus according to claim 1 wherein the platform assembly is formed adjacent the first portion, and the first and second portion of the upper clamp assembly are connected by a first closing mechanism and a second closing mechanism.

4. An apparatus according to claim 1 including:

the lower clamp assembly having an annular hollow body formed by a first portion and a second portion which are connected by a first closing mechanism and a second closing mechanism;

the upper clamp assembly having an annular hollow body formed by a first portion and a second portion, and the platform assembly connected to the first portion, which are connected by a first closing mechanism and a second closing mechanism; and wherein the annular hollow body of the upper clamp assembly substantially surrounds the a portion annular hollow body of the lower clamp assembly.

5. An apparatus according to claim 1 wherein the reaction adaptor assembly includes a force transmitting element to substantially negate reaction turning forces of the tool assembly during the operations.

6. An apparatus according to claim 1 wherein the lower clamp assembly, the upper clamp assembly, the reaction adaptor assembly, the spring assembly and the tool assembly are attachable separately, individually and independently to each other.

7. A system for conducting inverted operations of tightening or loosening a plurality of industrial threaded fasteners about an axis including: an apparatus having:

a lower clamp assembly non-rotatably connectable about the axis and including an annular hollow body formed by a first portion and a second portion;

an upper clamp assembly rotatably connectable about and extending around part of the lower clamp assembly, including an annular hollow body formed by a first portion and a second portion and having a platform assembly;

a reaction adaptor assembly configured to support a tool assembly;

a spring assembly formed between the platform assembly and the reaction adaptor assembly;

the reaction adaptor assembly is non-rotatably connectable to and vertically positionable from the platform assembly by the spring assembly; and a tool assembly comprising at least first and second fastener driving mechanisms non-rotatably connectable to the reaction adaptor assembly and rotatably connectable to the respective fasteners.

8. A system according to claim 7 wherein the first portion and a second portion of the lower clamp assembly are connected by a first closing mechanism and a second closing mechanism.

9. A system according to claim 7 wherein the platform assembly is formed adjacent the first portion, and the first and second portion of the upper clamp assembly are connected by a first closing mechanism and a second closing mechanism.

10. A system according to claim 7 including:

the lower damp assembly having an annular hollow body formed by a first portion and a second portion which are connected by a first closing mechanism and a second closing mechanism;

the upper damp assembly having an annular hollow body formed by a first portion and a second portion, and the platform assembly formed adjacent the first portion, which are connected by a first closing mechanism and a second closing mechanism; and wherein the annular hollow body of the upper clamp assembly substantially surrounds the annular hollow body of the lower clamp assembly.

11. A system according to claim 7 wherein the reaction adaptor assembly includes a force transmitting element to substantially negate reaction turning forces of the tool assembly during the operations.

12. A system according to claim 7 wherein the lower clamp assembly, the upper clamp assembly, the reaction adaptor assembly, the spring assembly and the tool assembly are attachable separately, individually and independently to each other.

13. A system according to claim 7 wherein the tool assembly includes:

a first and a second receiving member, rotatably supported in the tool assembly, for receiving a first and a second fastener;

a first and a second device for positioning of the respective receiving members to nonrotatably engage the respective fasteners; and a first and a second device for effecting rotation of the respective receiving members to tighten or loosen the respective fasteners.

14. A system according to claim 7 wherein the tool assembly is either pneumatically, electrically, hydraulically or manually driven.

* * * * *